United States Patent [19]

Hörlin

[11] 3,946,948

[45] Mar. 30, 1976

[54] EJECTOR

[75] Inventor: Dick Axel Hörlin, Grangesberg, Sweden

[73] Assignee: Grangesbergs Industrivaru AB, Grangesberg, Sweden

[22] Filed: Oct. 18, 1974

[21] Appl. No.: 516,134

[52] U.S. Cl. ..... 239/453

[51] Int. Cl.[2] ..... B05B 1/32

[58] Field of Search ..... 239/453, 553, 553.3, 553.5, 239/590, 590.3, 590.5; 417/158, 176, 151, 177

[56] References Cited

UNITED STATES PATENTS

| | | | |
|---|---|---|---|
| 372,070 | 10/1887 | Horne | 417/176 |
| 746,992 | 12/1903 | Rice | 239/553 |
| 2,191,717 | 2/1940 | Jeffery | 417/151 |
| 2,233,855 | 3/1941 | Suss | 239/453 |
| 2,550,100 | 4/1951 | Voss | 239/453 |
| 3,073,531 | 1/1963 | Kothe | 239/453 |
| 3,246,660 | 4/1966 | Hammelmann | 239/453 |
| 3,397,842 | 8/1968 | Frandsen | 239/453 |

*Primary Examiner*—Lloyd L. King
*Attorney, Agent, or Firm*—Karl W. Flocks

[57] ABSTRACT

An ejector comprises a nozzle for a motive fluid opening into a mixing zone, and a diffusor downstream of the mixing zone for the motive and entrained fluids. The motive jet nozzle is annular and has its mouth substantially radially outwardly directed. The diffusor consists of two spaced plates, discs or the like, and the nozzle is directed between the plates which are so arranged relative to one another that the cross sectional area between them increases in a radial sense, as viewed from the nozzle.

9 Claims, 2 Drawing Figures

2
12
11
3
5
1
4
6

EJECTOR

This invention relates to an ejector comprising a nozzle for a motive fluid opening into a mixing zone, and a diffusor downstream of the mixing zone for diffusing the motive fluid and the fluid entrained by it.

According to the invention, the nozzle is annular and has its mouth substantially radially outwardly directed, and the diffusor consists of two spaced plates, discs or the like, the nozzle being directed between the plates which are so arranged relative to one another that the cross sectional area between them increases in a radial sense, as viewed from the nozzle. The invention with the use of simple means thus provides a readily adjustable ejector of robust reliable construction.

Figure 1:
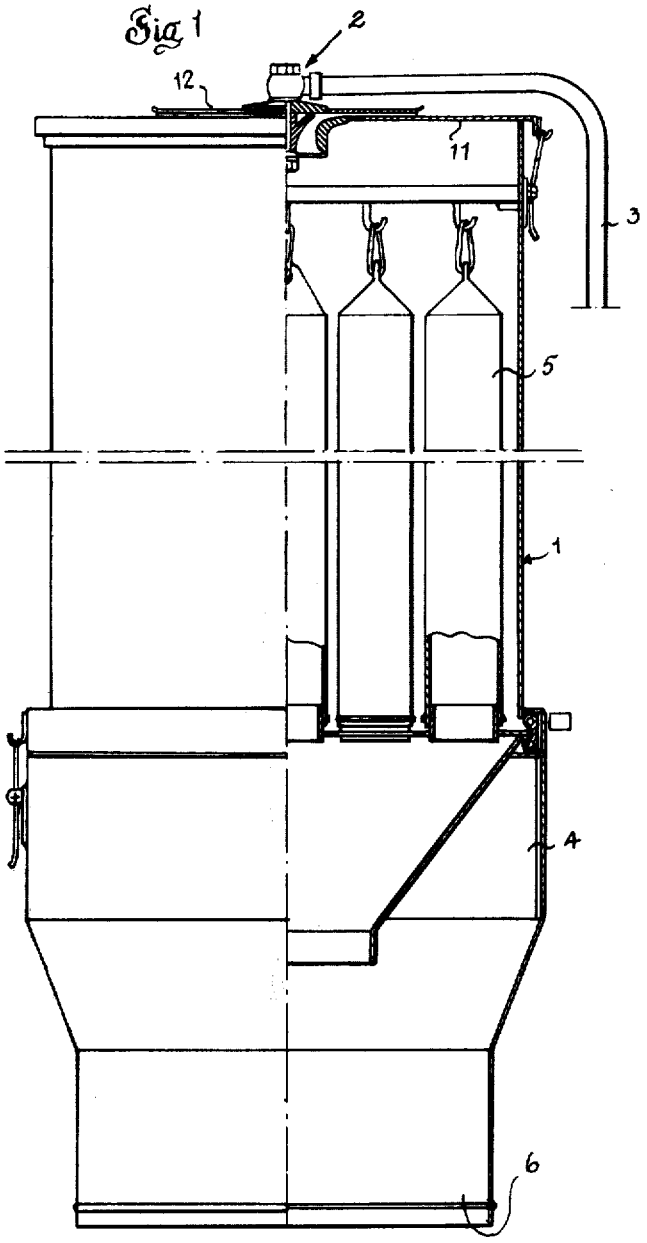
Figure 2:
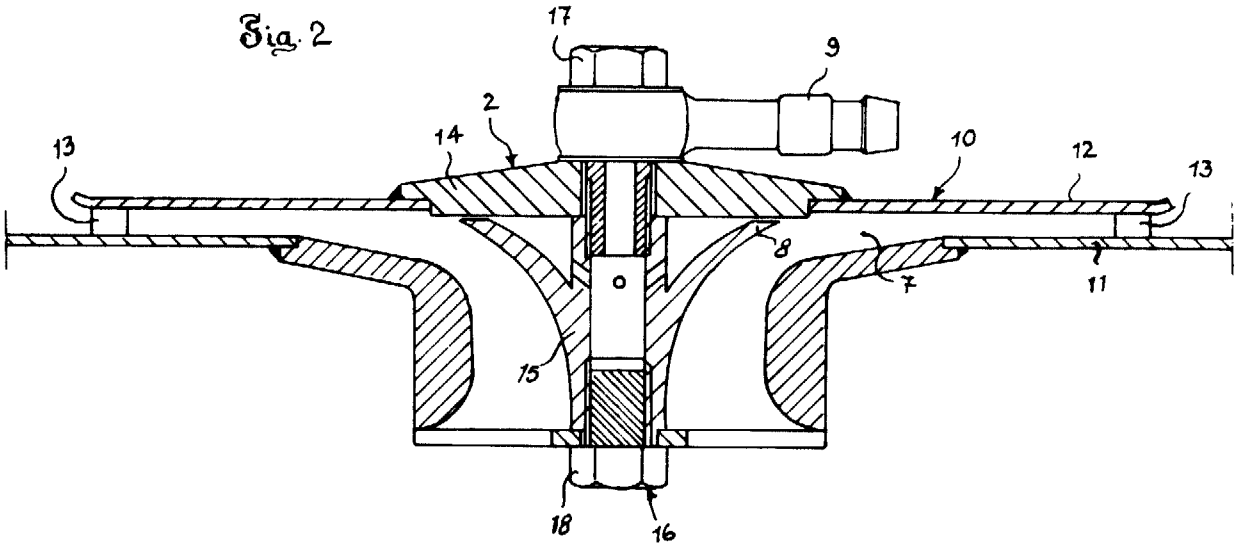

An embodiment of the invention will be more fully described hereinbelow and with reference to the accompanying drawings in which FIG. 1 is a side elevation, partly in section, of a dust exhauster or collector assembly equipped with the ejector;

FIG. 2 shows a section, on a larger scale, of the ejector proper.

The dust exhauster or collector assembly 1 illustrated in FIG. 1 of the drawings is primarily intended for use in rock drilling. For achieving the required suction, the ejector 2 of the assembly 1 is adapted to be connected by means of a hose 3 to a compressor or other source of compressed air. As shown in FIG. 1, the assembly 1 has in its lower part a cyclone 4 which is connected to the drilling site and in its upper part a filter device 5, said lower and upper parts of the assembly being tightly connected together. Both coarse and fine materials will thus be separated in the assembly 1. The separated material is discharged through the lower open end 6 of the assembly, to which a collecting bag or like means should be connected.

The ejector 2 is mounted at the upper end of the assembly 1 and consists of the motive jet nozzle 8 opening into the mixing zone 7, said nozzle being supplied with the motive fluid via the hose connecting socket 9, and of the diffusor 10 downstream of the mixing zone for diffusing the motive fluid and the fluid which said motive fluid entrains out of the assembly 1. The nozzle 8 is annular and has its mouth substantially radially outwardly directed. The diffusor 10 is formed by two spaced plates, panels or like means 11 and 12 between which the nozzle 8 is directed. The plates 11 and 12 are so arranged in relation to one another that the cross sectional area between them increases in a radial sense, as viewed from the nozzle 8.

In the embodiment illustrated, the plate 12 is smaller than the plate 11. More particularly, the plate 12, which determines the effective extension of the diffusor, is circular and its centre coincides with that of the annular nozzle 8. The plates 11 and 12 could, however, be of equal size.

As will appear from the drawing, the plates 11 and 12 are at least substantially plane parallel. Another relative orientation of the plates 11 and 12 is also conceivable.

The distance between the plates 11 and 12 is adjustable to permit setting the diffusor 10. According to the drawing, the central portions only of the plates 11 and 12 are adjustable relative to one another, since the plate 12 has its periphery connected to the plate 11 by the spacer means 13.

The size of the nozzle 8 can also be set. As shown in the drawing, the mouth of the nozzle 8 is formed by the gap between the plate 12 or the central portion 14 thereof and a substantially hopper-shaped portion 15 directed toward said plate or plate portion. More particularly, it is the distance of the hopper-shaped portion 15 to the plate 12 and the plate portion 14, respectively, that is adjustable for setting the width of the gap forming the mouth of the nozzle 8.

As will appear from the preferred embodiment illustrated in the drawing, the two plates 11 and 12 are interconnected at their centres by means of a device 16 which is combined with the annular nozzle 8, is equipped with the compressed air connecting socket 9, and permits setting the size of the nozzle 8 as well as the distance between the plates 11 and 12. The part of the device 16 combined with the nozzle 8 is the hopper-shaped portion 15 whose outer side constitutes a vane for the pumped air. The hopper-shaped portion 15 is provided with a central tube portion which at one end cooperates with the connecting bolt 17 and at the other end with the bolt 18. The bolt 17 permits setting the size of the nozzle 8, whereas the bolt 18 permits setting the distance between the plates 11 and 12, for instance with the aid of washers.

Besides, a combination effect is gained with the ejector 2 according to the present invention since the plate 11 of the diffusor 10 simultaneously serves as a lid for the container or like vessel to which the ejector 2 is connected. The upper part of the assembly accommodating the filter device 5 is thus an upwardly open cylindrical container which is closed by the lid-forming plate 11 which is part of the ejector 2.

The invention should not be considered limited to the embodiment described above and shown in the drawing since it admits of modification within the spirit and scope of the appended claims.

What I claim and desire to secure by Letters Patent is:

1. An ejector comprising a nozzle for a motive fluid opening into a mixing zone, and a diffusor downstream of the mixing zone for the motive and entrained fluids, wherein the motive jet nozzle is annular and has its mouth substantially radially outwardly directed, and the diffusor consists of two spaced plates or discs, the nozzle being directed between the plates which are so arranged relative to one another that the cross sectional area between them increases in a radial sense, as viewed from the nozzle.

2. An ejector as claimed in claim 1, wherein at least one of the plates which is not larger than the second plate, is circular and its centre coincides with that of the nozzle.

3. An ejector as claimed in claim 1, wherein the plates are at least substantially plane parallel.

4. An ejector as claimed in claim 1, wherein the distance between the plates is adjustable.

5. An ejector as claimed in claim 1, wherein the size of the nozzle is adjustable.

6. An ejector as claimed in claim 1, wherein the mouth of the nozzle is formed by the gap between one of the plates and a substantially hopper-shaped portion directed toward said plate.

7. An ejector as claimed in claim 6, wherein the distance of the substantially hopper-shaped portion to the plate toward which said portion is directed, is adjustable for setting the width of the gap forming the mouth of the nozzle.

8. An ejector as claimed in claim 1, wherein the two plates are interconnected at their centres by a device which is combined with the annular nozzle, is equipped with a connection for the motive fluid, and permits setting the size of the nozzle as well as the distance between the plates.

9. An ejector as claimed in claim 1, wherein one of the spaced plates constituting the diffusor is in the form of a lid for a container or like vessel to which the ejector is to be connected.

* * * * *